the ring 46 is pushed down over the uppermost flange of the bottle. In passing, it should be noted that at this time the zones 78, 80 will not be ruptured. Indeed, these zones will not be ruptured even when the stopper is withdrawn from the neck of the bottle and is propelled therefrom.

Attention is also drawn to the dimensions and configurations of the stopper 42, but before that it should be mentioned that the stopper is intended to be received in the neck of a domestic champagne bottle which is of more or less a standard configuration but which will be described here for the purpose of completeness. The cork unit is designed to be received in the elongated neck of two different sizes of wine bottles, one having a capacity of 750 milliliters and the other having a capacity of 1500 milliliters. For the sake of economy in the production of the cork unit and of the bottles, the elongated necks of both of these bottles are substantially identical.

Aside from the upper and lower flanges which have already been described, the opening of the mouth of a bottle is internally upwardly flaring and generously rounded to permit facile introduction of the lower end of the sleeve 48. At about 0.20 inches down from the mouth of the neck the inner diameter of the neck is approximately 0.64 to 0.67 inches. This diameter is maintained for approximately 0.60 inches from the top of the mouth of the bottle. This more or less cylindrical portion of the inner surface of the neck of the bottle is suitable to receive the slightly downwardly tapering configuration of the sleeve 48 and to frictionally engage the same portion at the rings 58. The frictional fit between the ringed sleeve and the inner surface of the cylindrical portion of the bottle neck is sufficiently tight to retain the sleeve in position against fairly substantial internal gas pressures in the head space of the bottle, a task which is assisted by the presence of a retention cage or bail.

Returning now to the description of the stopper 42, the length of the stopper from the crown 52 down is about 0.945 inches. The stopper must make a tight frictional fit with the internal surface of the neck of the bottle in order to maintain a substantial gas pressure in the head space of the bottle. On the other hand, if the entire surface of the stopper which is engaged with the internal surface of the neck of the bottle makes such a tight frictional fit it would be extremely difficult to withdraw the stopper to gain access to the contents of the bottle. As a compromise, the stopper is provided with the several, e.g. four, annular squat rings 58 which are of downwardly progressively lesser radial heights, that is to say the top ring 58 projects radially the furthest from the external surface of the stopper and as the rings are located lower and lower on the stopper their radial height becomes less and less. Specifically, by way of example, the uppermost ring projects radially from the surface of the stopper approximately 0.016 inch. The next lower ring projects radially about 0.014 inch. The third ring down projects radially about 0.012 inch and the fourth ring projects a radial distance of about 0.010 inch. The fourth ring is the apex of a downwardly tapering cone which acts as an introductory pilot to guide the stopper into the mouth of the bottle at the time the stopper is inserted in the bottle. Because the stopper is quite a tight fit into the neck of the bottle, the stopper is constricted as it is introduced into the bottle; the stopper, therefore, has to constrict inwardly in a radial direction and for this purpose is made thin enough, a typical radial thickness being 1/16 of an inch.

Furthermore, it should be pointed out that the uppermost ring of is approximately $\frac{1}{4}$ of an inch below the disk 76 to enable the upper ring to engage the upper constricted portion of the interior of the neck of the bottle, and that the rings 58 are spaced about $\frac{1}{8}$ of an inch apart axially so that all the rings will engage the narrow part of the interior of the bottle.

From the foregoing description of the cork unit 40 it will be seen that the unit is very compact in its as-molded state prior to assembly with a bottle. It has no loop-like protruberances or spurs which would tend to become entangled with portions of other like units and hence units in a randomly oriented mass will not become entangled with one another so that individual units easily can be segregated from such a mass in a vibrating hopper. Moreover, the unit although symmetrical about the longitudinal axis of the sleeve 48 is asymmetrical in elevation or, in other words, has a configuration such that its shape at the top is different from its shape at the bottom. As can be seen, for example, from inspection of FIGS. 2, 3 and 4, the major portion of the height of the unit is in the surface configuration of a frustum of a cone with the narrow end up and the broad end down and the bottom of the unit has the lower end of the sleeve 48 projecting slightly therefrom.

The tethers are neatly tucked in between the disk 78 and the ring 46. The tethers are held in place prior to assembly on a bottle by the zones 78, 80, the bridges 82 and the links 84, so that the unit readily lends itself to withdrawal of single units seriatim in predetermined orientation ready for insertion, with the projecting end of the sleeve lowermost, into the mouth of a bottle.

The particular structure of the hopper and outfeeding device used and the devices for eliminating improperly oriented units in the outfeeding device are will-known in the art and, therefore, have not been shown or discussed and at this point it would suffice to say that stopper units 40 arranged one after another in series are withdrawn from a hopper (not shown) associated with the station 24 and the stoppering head 38 and fed to a chute 86 (see FIGS. 1 and 5) with their projecting lower ends lowermost and extending downwardly between the rails of the chute as clearly indicated in FIG. 5. Opposed diametric portions of the lower surface of the ring 46 ride on the upper surfaces of the chute as likewise indicated in FIG. 5. The chute is inclined downwardly from the hopper except for its terminal portion 88 immediately adjacent to the stoppering head 38. At this time the units are biased to be fed in the direction of the arrow "A" shown in FIG. 5 by the force of gravity acting on the cork units 40 in the inclined portion of the chute immediately preceding the terminal portion. The foremost cork unit at the terminal portion 88 of the chute has its advance movement checked by a cork unit 40' (FIG. 5) short of a die nest 90 mounted for vertical reciprocation as indicated by the arrow "B" (FIG. 5).

The die nest is shown in its uppermost position in FIGS. 5, 6 and 7. The die nest is located above any one of a circular series of anvils (not shown) disposed on a carrier 32 which are intermittently stationed below and in registry with said die nest. That is to say, the carrier 32 brings anvil after anvil, on each of which there is an erect filled bottle with an open mouth, directly below and centered with the die nest 90 and momentarily holds the same stationary thereat.

CONTAINER WITH INTEGRALLY FORMED NON-CORING AND NON-LEAKING PIERCING SITE

BACKGROUND OF THE INVENTION

This invention relates to a molded plastic container having a non-coring, non-leaking piercing site and more particularly to a container in which such a site is integrally formed in said container.

The transfer of medicaments for patient treatment in a hospital or patient care setting between a container and a supply line, or between containers, is frequently accomplished by use of a needle and syringe, a transfer needle, or a needle (or spike) on the end of a solution transfer set.

For the withdrawal or addition of liquid or solution by needle and syringe or by transfer needle to or from a container, a typical container now in use is provided with a rubber stopper with a "thinned" or diaphragm-like section through which the metal needle is inserted. The function of the diaphragm configuration is to provide an entry site capable of being penetrated by the needle and to provide a seal around the needle shaft, and to permit penetration of the rubber without cutting out a small portion or core of rubber by the "heel" of the needle when the latter is thrust through the diaphragm section of the stopper. The supple and elastometric properties of the rubber make this penetration possible.

Lodging of the aforementioned portion or core of the rubber in the lumen of the needle, referred to as coring by the needle, presents the possibility of introducing this "particle" into the blood stream of the patient as well as interfering with the transfer of the solution and is to be avoided.

When a transfer set is employed to transfer solutions from a container to a supply line, a larger diameter plastic needle is generally employed in a manner similar to the use of the metal needle as described above. In this situation, coring by the needle is to be avoided also, but sealing around the needle as it penetrates the stopper is more difficult to accomplish since it has been found that the hole formed by the larger diameter plastic needle tends to be irregular.

Containers currently in use are made of either glass or rigid plastic construction with the rubber stopper or a flexible bag in which there is a fabricated or built-up segment with a tubular appendage to accommodate or support the diaphragm-like membrane to be pierced by the metal or plastic needle.

Such containers currently in use are constructed of separate parts which must be assembled or fabricated. As the contents of the containers are usually sterile and it is necessary to maintain such sterility during the packaging process, it is apparent that there are significant costs involved in componentry and manufacture or processing to produce such a system of providing sterile medicaments to a hospital or patient bedside environment.

Recent developments in the technology of manufacturing plastic containers make it possible that a container can be formed, filled with sterile, non-pyrogenic solution, and sealed under sterile conditions in a single step. Even though machinery to accomplish such a manufacturing process is available, however, it has not been possible up to now to produce a container construction which can be formed in this way which will prevent coring of the needle as it penetrates the container and provide sealing around the shaft of the needle as it is thrust into the container.

Methods and apparatus for the molding and sealing of plastic containers are shown in U.S. Pat. Nos. 3,851,029 and 4,172,534. It is noted that the latter patent does deal with the problem of providing a needle puncture site, but the construction is an expensive one and does not take full advantage of the molding technology now available.

SUMMARY OF THE PRESENT INVENTION

In accordance with the principles of this invention, there is provided a container capable of being blow molded, filled with solution, and sealed with an integrally formed site which is non-coring and non-leaking when penetrated by a needle.

It has been found that the action performed by the diaphragm section of a rubber stopper as described above can be simulated in an integrally formed section by forming a double dome in the container in lieu of, and in close proximity to where the stopper would ordinarily be located in a conventional container.

The double dome comprises a main dome extending radially beyond the neck of the container and a smaller or secondary dome located somewhat off center on the upper surface of the main dome. The mold seam on the main dome is directed away from the center line of the main dome so as to avoid intrusion into the structural formation of the secondary dome.

The thickness of the plastic in the main dome is sufficient to support its shape and resist forces of deformation caused by penetration of the secondary dome during penetration. The thickness of the secondary dome is somewhat less than that of the main dome and is a function of the manufacturing process and its location, size, and depth.

In the preferred embodiment of this invention there is provided a blow molded plastic container having a main body, a neck portion communicating with and extending from the main body, and a hollow dome of larger diameter than the neck formed on the opposite end of the latter. The dome is fully enclosed, is generally circular and concentric with the neck, and has a uniformly curved outer surface in which is located a secondary dome of smaller diameter offset from the main dome center line in the direction away from the main dome mold seam.

In order to penetrate the container with a needle to effect the transfer of liquid, the pointed end of the needle is impressed on the secondary dome. A dimple is first formed in the wall of the secondary dome as the needle penetrates the secondary dome.

Dimpling of the surface of the secondary dome prevents coring by the needle, and, for a steel needle of small diameter, insures intimate contact between the plastic material and the shaft of the needle to insure proper sealing while the needle remains inserted in the container.

For use with a plastic needle, the interior surface of the neck is calibrated in diameter to match the diameter of the larger plastic needle so that sealing is maintained where the outer surface of the plastic needle is in contact with the inner surface of the neck.

The above described construction therefore is capable of accommodating both the metal and plastic needles, in both cases preventing coring by the needles and insuring proper sealing while a needle is being used to transfer liquid.

It is thus a principal object of this invention to provide a molded sealed container having a non-coring and non-leakage site of integral construction.

Other objects and advantages of this invention will hereinafter become obvious from the following description of preferred embodiments of this invention.

FIGS. *4a–4d* illustrate penetration of the secondary dome by a steel needle.

Figure 1:
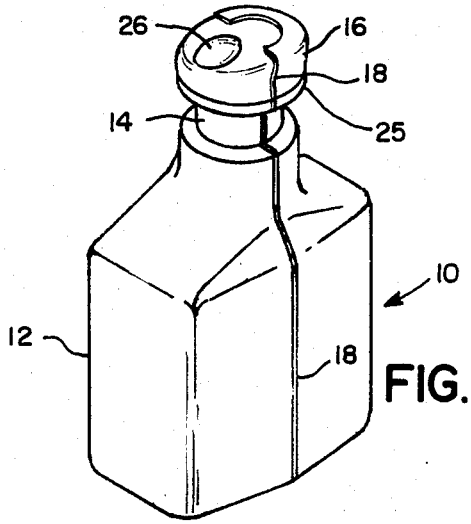
FIG. 1 is an isometric view of a container embodying the principles of this invention.
Figure 4A:
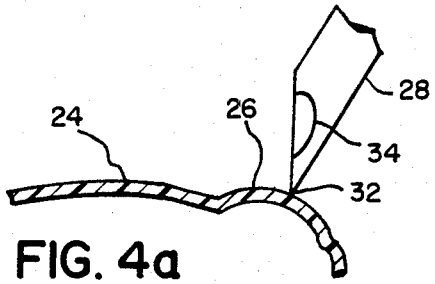
Figure 4B:
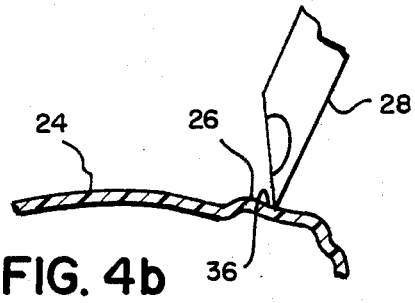
Figure 5:
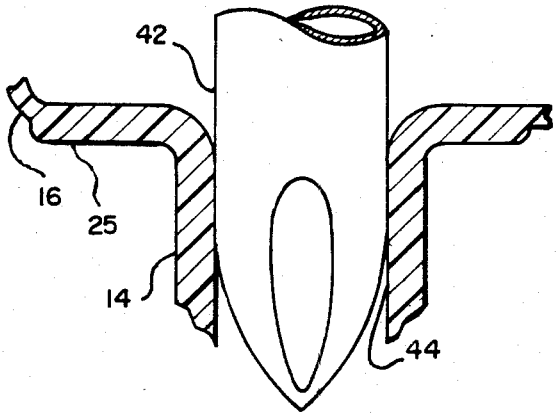

FIG. 5 illustrates the insertion of a plastic needle into the container shown in FIG. 1.

DETAILED DESCRIPTION OF THE PREFERRED EMBODIMENT

As illustrated in FIG. 1, container 10 consists of a hollow main body 12 which may be of any convenient cross section, such as square, rectangular, or circular, a neck portion 14, of uniform, circular inside diameter over a significant portion of its length, and a symmetrical main dome 16 of larger cross section.

As container 10 is blow molded from any suitable plastic material commercially available having the characteristics to be described later, there would be a mold seam 18 as is understood in the art whose location would depend on the equipment being employed to manufacture the container.

Figure 2:
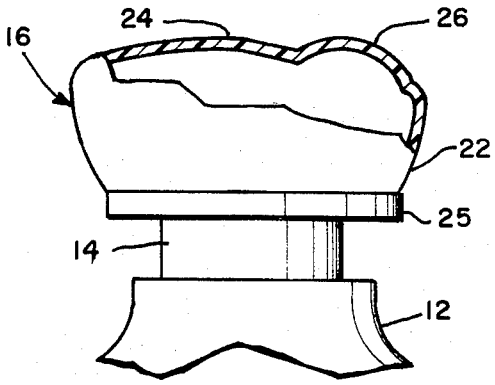
FIG. 2 is a side view of the upper portion of the domes partially cut away.
Figure 4C:
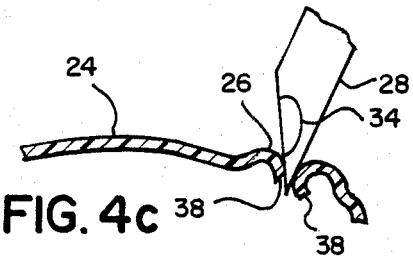
Figure 4D:
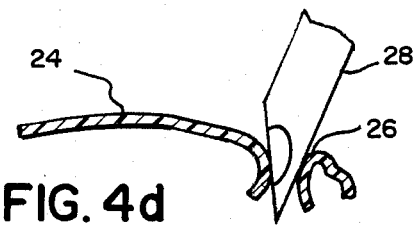
Figure 3:
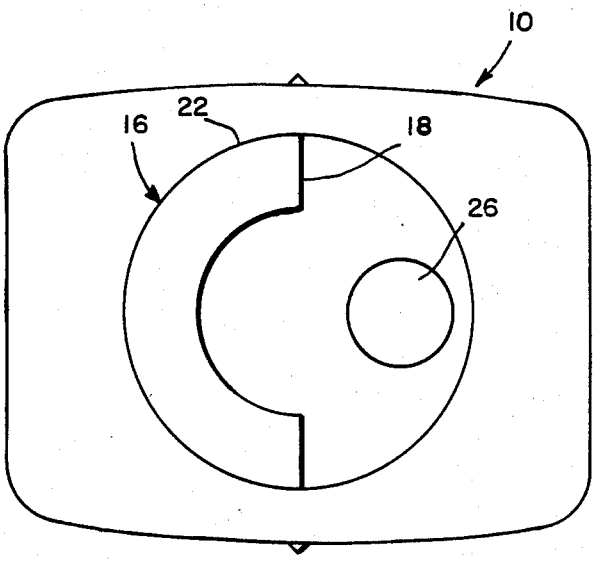
FIG. 3 is a plan view of the dome shown in FIG. 2.

Referring more particularly to FIGS. 2 and 3, the integrally formed non-coring and non-leaking site comprising principal aspects of this invention includes main dome 16 having a generally circular outer rim 22 and an upper, outer surface or shell 24 which is generally uniformly curved and bulging outwardly and of uniform thickness. A shoulder 25 provides additional support for dome 16.

Formed in outer surface 24 is a secondary dome 26 offset from the center line of neck 14 having a diameter substantially less than the diameter of dome 16 and reduced in thickness. Seam 18, it will be noted, is curved away from secondary dome 26 on the opposite side of the center line mentioned above so as not to pass through the latter nor in any way interfere with, or influence, the shape or thickness of the secondary dome. The vertical height of main dome 16 should be at least as high as and preferably higher than that of secondary dome 26 to permit machine trimming of excess material from mold seam 18 without damaging secondary dome 26.

The plastic material comprising container 10 is sufficiently rigid to maintain its shape as shown in the course of ordinary use and handling but is sufficiently yielding or flexible, as it understood in the art, to function in the manner hereinafter described.

Referring to FIGS. *4a–4d*, hollow steel needle 28 with its pointed tip 32 and opening or lumen 34 is shown penetrating secondary dome 26. It is understood that needle 28 may extend from a syringe (not shown) or may be simply a transfer needle device into which liquid from container 10 is to be transferred, or vice versa.

As seen in FIG. *4a*, tip 32 of needle 28 is placed on the center of said secondary dome 26 in the direction of and a slight angle of the order of 20% off the center line of neck 14, and as the needle 28 is thrust downwardly, a dimple 36 first forms in the wall of dome 26 and the needle 28 then penetrates the wall. Dimpling prior to penetration is made possible by the preferred shape and reduced thickness of dome 26 as compared to main dome 16 and is necessary because it permits the exposed edge 38 of dome 26 to be directed away from lumen 34 so that coring will not occur, and in addition, as needle 28 is thrust into main body 12, the downwardly curved exposed edge of the plastic wall is biased against the outer surface of needle 28 thereby providing a seal which prevents contaminants from entering container 10.

Some bending downwardly of outer surface 24 of main dome 16 is permissible, but the thickness of dome 16, especially side wall 22, must be sufficient to prevent a collapse of the latter, which is described herein as a catastrophic deformation of main dome 16 and is to be avoided. The bulging of outer wall 24 outwardly is an important feature which permits some minor deformation but helps prevent collapse or catastrophic deformation of dome 16, with shoulder 25 contributing to this result.

It has been found that when a plastic transfer needle of larger diameter is employed with container 10 that coring is not likely to occur; however, proper sealing around the needle as it penetrates dome 16 does not occur, apparently due to a non-uniformity in the opening which is made by the needle. Penetration by such a large diameter needle is possible due also to the preferred shape and preferentially thinned section of secondary dome 26 as described.

As seen in FIG. 5, in order to obtain proper sealing when a plastic needle 42 is employed, neck 14 formed as part of container 10 has an inside surface 44 circular in cross section with a diameter which is no greater than the outside diameter of needle 42, and is calibrated in its I.D. to cooperate with the plastic needle O.D. and is seamless and uniform for a significant length to insure sealing between needle 42 and surface 44. In bottles of relatively small capacities such as a 5 ml. where a plastic needle may not be employed, it would probably not be necessary to provide a neck I.D. of calibrated dimension thereby avoiding one extra step in the molding process if said calibration were not employed.

Container 10 thus may be employed with either steel needle 28 or the conventional oversized plastic needle 42 except for the particular situation noted above. Under some conditions, container 10 may be used for the transfer of gaseous medicaments as well as liquids.

A container made according to the principles of this invention may be blow molded, filled with medicament or aqueous solution and sealed in one continuous operation using commercially available machinery. For example, containers according to the shape shown in the figures were molded from a tenite polyallomer (M 7853-296E), made by Eastman Chemical Co., and a low density polyethylene (Rexene PE 107) made by El Paso Polyolefins Co. Both are commercially available. The machine employed was the "Bottle Pack" manufactured by Kocher Plastik, Sulzbach-Laufen, West Germany. Main dome diameter was 14 mm., rim height was 1 mm., overall height of dome 16 to top of secondary dome 26 exclusive of shoulder 25 was 6.5 mm., and dome 26 diameter and depth were 5.5 mm and 1 mm., respectively. Secondary dome wall thickness was a minimum of 0.2 mm to prevent coring and provide proper sealing with a steel needle, and generally was in the range of 0.2 to 0.25 mm. The thickness of main dome 16 was greater.

It is thus seen that there has been provided a container having an integrally formed non-coring and non-leaking piercing site for penetration by steel and plastic needles.

The container made according to the principles of this invention makes it possible to produce high quality and reliable containers at a cost which is far less than the cost of containers which have been available up to now suitable for the application herein described.

While only preferred embodiments of this invention have been disclosed, it is understood that various changes and modifications thereof are possible without departing from the principles of this invention as defined in the claims which follow.

What is claimed is:

1. A blow molded sealed container of integral construction having a piercing site for penetration by a steel or plastic needle comprising:

a. a main body for containing or receiving a liquid;

b. a hollow neck portion extending from and communicating with the interior of said main body; and c. hollow, fully enclosed main dome means formed on the opposite end of said neck portion communicating with the interior of said neck having a generally uniformly curved outwardly bulging shell of uniform thickness substantially circular in diameter greater than, and concentric with the central axis of, said neck, the outer surface of said shell having formed therein a needle penetration site consisting of a secondary dome axially offset from the center line of said neck and whose diameter is less than the diameter of said curved shell.

2. The container of claim 1 in which the wall of said main dome means is sufficiently thick to prevent catastrophis deformation of said main dome means as said steel or plastic needle dimples and penetrates said secondary dome, the wall thickness of the latter being significantly less than the wall thickness of said main dome means to insure non-coring penetration by said steel or plastic needle of said secondary dome and maintenance of sealing around the outer surface of said steel needle.

3. The container of claim 2 having a mold seam passing through said main dome means, said seam on the outer surface of said main dome means curving away from said secondary dome.

4. The container of claim 3 in which the center line of said secondary dome extending into said main dome means is at an angle of the order of about 20 degrees from the center line of said neck portion, and the vertical height of said main dome means is at least as high as the vertical height of said secondary dome.

5. The container of claim 1 in which said neck has a circular inside opening of uniform diameter matching the diameter of said plastic needle for a significant distance to prevent leaking.

* * * * *